US007653330B2

(12) United States Patent
Hong et al.

(10) Patent No.: US 7,653,330 B2
(45) Date of Patent: Jan. 26, 2010

(54) IMAGE FORMING APPARATUS TO FORM AN IMAGE USING A DISPLAY UNIT, AND PRINTING METHOD THEREOF

(75) Inventors: Seock-deock Hong, Suwon-si (KR); Jung-ho Bang, Pocheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 259 days.

(21) Appl. No.: 11/696,292

(22) Filed: Apr. 4, 2007

(65) Prior Publication Data

US 2008/0056762 A1 Mar. 6, 2008

(30) Foreign Application Priority Data

Aug. 29, 2006 (KR) ..... 10-2006-0082495

(51) Int. Cl.
*G03G 15/22* (2006.01)

(52) U.S. Cl. ..... 399/130

(58) Field of Classification Search ..... 399/130, 399/140, 156, 157, 177, 218, 219, 220, 221
See application file for complete search history.

(56) References Cited

U.S. PATENT DOCUMENTS 4,134,668 A 1/1979 Coburn
4,935,749 A * 6/1990 Sakakibara et al. ..... 347/228
5,220,377 A * 6/1993 Suzuki et al. ..... 355/405
6,427,062 B1 * 7/2002 Takeuchi ..... 399/388
6,889,021 B2 * 5/2005 Lin et al. ..... 399/162

FOREIGN PATENT DOCUMENTS

| | | |
|---|---|---|
| JP | 54-69317 | 6/1979 |
| JP | 57-105757 | 7/1982 |
| JP | 58-139560 | 8/1983 |
| JP | 60-82371 | 5/1985 |
| JP | 09-39292 | 2/1997 |
| JP | 2000-006470 | 1/2000 |
| JP | 2006-076195 | 3/2006 |

OTHER PUBLICATIONS

European Search Report dated Dec. 20, 2007 issued in EP 07110309.7.

* cited by examiner

*Primary Examiner*—Hoan H Tran
(74) *Attorney, Agent, or Firm*—Stanzione & Kim LLP

(57) ABSTRACT

An image forming apparatus includes a display unit which outputs image data in the form of a complete image, a photosensitive medium which forms an electrostatic latent image corresponding to the image outputted from the display unit, a developing unit which develops the electrostatic latent image formed on the photosensitive medium, a transfer unit which transfers the developed image of the photosensitive medium onto a printing medium, and a fixing unit which fixes the transferred developed image in the printing medium.

29 Claims, 13 Drawing Sheets

IMAGE FORMING APPARATUS TO FORM AN IMAGE USING A DISPLAY UNIT, AND PRINTING METHOD THEREOF

CROSS-REFERENCE TO RELATED APPLICATIONS

This application claims priority under 35 U.S.C. § 119(a) of Korean Patent Application No. 2006-82495 filed on Aug. 29, 2006, in the Korean Intellectual Property Office, the entire disclosure of which is hereby incorporated by reference.

BACKGROUND OF THE INVENTION

1. Field of the Invention

The present general inventive concept relates to an image forming apparatus. More particularly, the present general inventive concept relates to an image forming apparatus which forms an image using a display apparatus, and a printing method using the same.

2. Description of the Related Art

An image forming apparatus is generally classified into a monochromatic type which forms black and white images, and a color type which forms color images. A color image forming apparatus is generally classified into a multi-pass type which rotates one image bearing member a plurality of times to form an image, and a single-pass type which rotates a plurality of image bearing members one time to obtain a color image.

First, the monochromatic type image forming apparatus will be explained briefly below.

With reference to FIG. 1A, a print medium (referred to as "paper" below) is picked up by a paper feeding part 11 of the main body 10, and fed between a developing machine 12 and an image transfer roller 13. A photosensitive medium such as a photosensitive drum 12*a* is housed in the developing machine 12, and an electrostatic latent image is formed on the photosensitive medium by the light beam emitted from a laser scanning unit (LSU) 14. A developer agent such a toner is supplied to the electrostatic latent image of the photosensitive drum 12*a*, and the developer image of the photosensitive drum 12*a* is transferred onto the paper sheet which is passed through the transfer roller 13 and the photosensitive drum 12*a*. The paper sheet, bearing the developer image thereon, is conveyed to a fusing part 15 where the image is fixed onto the paper sheet by the high temperature heat and high pressure. After exiting out of the fusing part 15, the paper may be discharged out, or returned through a paper reversing route, which is not shown, for image forming on the other side of the sheet, that is, for duplex printing.

FIG. 1B schematically illustrates the structure of a multi-pass type image forming apparatus.

Referring to FIG. 1B, a multi-pass type image forming apparatus is constructed to form a color image by rotating one image bearing member (referred to as a "photosensitive drum" below) several times. The multi-pass type image forming apparatus forms unit color images such as yellow, magenta, cyan, or black in turn and then transfers the unit color images onto a transfer medium such as transfer belt 27 where the unit color images are overlapped on another. The full color image of the transfer belt 27 is then transferred onto the paper sheet P. Therefore, one image bearing member 21 is rotated four times, and the transfer belt 27 is also rotated four times to form one full color image.

More specifically, in printing operation, K, C, M and Y developing machines 22, 23, 24, and 25, formed near to the photosensitive drum 21 respectively, form unit color images.

That is, a Y color image is formed on the image bearing member 21 and transferred onto the transfer belt 27 by a first transfer roller 26 via a first transfer nip area N1 between the transfer belt 27 and the photosensitive drum 21. During this procedure, the second transfer roller 28 is at a distance from the transfer belt 27.

Next, an M color image is formed on the image bearing member 21, and transferred via the first transfer nip area N1 onto the transfer belt 27 now bearing the Y color image. Following the M color image, a C color image is transferred onto the transfer belt 26 already bearing the Y and M color images.

When a K color image is formed on the photosensitive drum 21 as the last unit color image, forming a full color image on the transfer belt 27, the second transfer roller 28 is moved to a position as indicated by dotted circles in FIG. 1B, creating a second transfer nip area N2 by contact with the transfer belt 27.

While the unit color images are being transferred onto the transfer belt 27, the paper sheet P picked up by the pickup roller from the paper feeding part 20 is fed toward the second transfer nip area N2.

Then, as the paper sheet P passes through the second transfer nip area N2, the full color image is transferred onto the paper sheet P.

The full color image is fused onto the paper sheet P by high temperature heat and high pressure as the paper sheet P passes through a fusing part 29. After passing through the fusing part 29, the paper sheet P is released.

Meanwhile, a laser scanning unit (LSU) 30 is needed to form an electrostatic latent image on the photosensitive drum 21, before the unit color images are formed on the photosensitive drum 21 by the color developing machines 22, 23, 24, 25 (FIG. 1A). The LSU 30 carries out a laser scanning operation in four cycles of a developing process to form the four color images, generally in the same manner as that of a monochromatic image forming apparatus.

In a single-pass type image forming apparatus, as shown in FIG. 1C, a plurality of image bearing members such as four photosensitive drums 41, 42, 43, 44 may be provided to form yellow, magenta, cyan and black color images. In this case, the color images of the four photosensitive drums 41, 42, 43, 44 are sequentially transferred onto the transfer medium such as the transfer belt 45 while the transfer belt 45 rotates once, and thus form a full color image. To this end, there are developing machines 51, 52, 53, 54 corresponding to the image bearing members 41, 42, 43, 44, and laser scanning units (LSUs) 60 corresponding to the photosensitive drums 41, 42, 43, 44.

Accordingly, it is possible to shorten the time to form a full color image on the transfer belt 45 to one rotation. After being transferred onto the transfer belt 45, the color image is again transferred onto a paper sheet P passing between the transfer roller 46 and the transfer belt 45. The paper sheet P bearing the color image is passed via the fusing part 47 and released.

The image forming apparatuses, whether they are monochromatic, single-pass, or multi-pass type, all use a laser scanning unit (LSU) to form an electrostatic latent image on the photosensitive medium. FIG. 2 shows one example of the LSU.

Referring to FIG. 2, a general LSU includes a light source 61 which emits a laser beam, a collimator lens 62 which changes the laser beam of the light source 61 into parallel rays or converging rays with respect to a light axis, a cylinder lens 63 which converges the parallel light rays only in a sub-scanning direction, a polygon mirror 64 which moves the laser beam passing through the collimator lens 62 and the cylinder lens 63 at a uniform linear velocity for scanning, a polygon mirror driving motor 65 which rotates the polygon mirror 64 at a uniform angular velocity, an F-theta lens 66 which has a refractive divergence with respect to the light axis and deflects the laser beam at a uniform velocity from the polygon mirror 64 in a main scanning direction, corrects aberration, and focuses the light beam onto a scanning surface, an image focusing reflective mirror 67 which reflects the laser beam passing the F-theta lens 66 such that the light beam is focused on the surface of a photosensitive medium, such as photosensitive drum 70, to form an electrostatic latent image, a sensor 68 which receives the laser beam, and a synchronous signal detection reflective mirror 69 which reflects the laser beam toward the synchronization sensor 68.

As explained above, conventionally, many optical parts of different functions are employed to form an electrostatic latent image on the photosensitive medium, and as a result, the LSU has the complicated structure.

The LSU 60 explained above, in particular, has a structure in which the image, in units of pixels, is formed by successive scan lines. Therefore, the image forming process is slow. Considering that there are increasing demands for high-speed printing and continuing attempts to increase the speed of the LSU, operating the driving motor 65 for rotating the polygon mirror 64, processing the image data, and operating the photosensitive medium and the developing machine in synchronization with each other, as in the LSU of the above structure, will be inefficient. In addition, synchronizing the parts with each other itself is a difficult process.

When one of the above components is slowed, it causes overall speed to decrease. It is particularly difficult to increase the rotational speed of the driving motor 65. More specifically, the driving motor 65 frequently has vibration during high-speed rotation, and it is difficult to precisely control the driving motor 65 to a uniform speed. The vibration can be reduced, but at the cost of reducing the rotational speed of the driving motor 65. Therefore, there is a limit to the printing speed.

Additionally, the light scanning direction at the surface of the of the photosensitive medium 70 is perpendicular to the rotation axis of the polygon mirror 64, and this causes lines of image data, in the electrostatic latent image, to form on the photosensitive medium 70 with skew. The technology to compensate for the skew is available, such as emitting the scanning light at an inclined angle to take the skew compensation value into account, but this requires a very complicated control mechanism, and still does not basically solve problems like skew. Particularly in the multi-pass or single-pass type image forming apparatus, the unit color images have to be in registration with each other in both the main and sub scanning directions, and problems such as these can interfere with registration.

The color images can be made in registration with each other by software, but exactly aligning the color images at the scale of one pixel is very difficult because of mechanical instability of the components related to the image formation, such as the photosensitive medium, the driving system, or the like. For example, although the manufacturer aims to form a clear-cut circular section when he makes the photosensitive drums, in practice it is hardly achievable, and therefore, errors are generated between the image data and this causes deterioration of image quality. Therefore, effort, time and costs are required to improve the mechanical precision and speed control of the components. However, there still is a limit to precise alignment of the image data in registration with each other.

SUMMARY OF THE INVENTION

The present general inventive concept provides an image forming apparatus capable of solving fundamental problems of a laser scanning unit (LSU), by use of a display unit instead of the LSU, and a printing method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing an image forming apparatus, including a display unit to output image data in the form of an image, a photosensitive medium to form an electrostatic latent image corresponding to the image outputted from the display unit, a developing unit to develop the electrostatic latent image formed on the photosensitive medium, a transfer unit to transfer the developed image of the photosensitive medium onto a printing medium, and a fixing unit to fix the transferred developed image in the printing medium.

The image forming apparatus of claim 1 may further include a plurality of support rollers, wherein the photosensitive medium comprises a photosensitive belt to move in a direction, while being supported on the plurality of support rollers.

The photosensitive medium may include a photosensitive drum to rotate in a direction.

The developing unit may include a plurality of individually operating color developing units to develop the electrostatic latent image.

The display unit may be flexibly formed such that the display unit is deformable to a configuration of the photosensitive medium.

The display unit may include a movable unit to move the display unit close to or away from the photosensitive medium.

The movable unit may include a pressing member to press the display unit to move away from the photosensitive medium, and a driving unit to forcibly move the display unit close to the photosensitive medium against the force of the pressing member.

The driving unit may include a cam member.

The driving unit may include a solenoid.

The image forming may further include a lens disposed between the display unit and the photosensitive medium to guide an image output from the display unit toward the photosensitive medium.

The output image data may be output in the form of an image including at least one of a red image, a green image and a blue image.

The display unit may include at least one of an LCD, a PDP, an LED and a CRT.

The image forming apparatus may further include a reciprocating unit to reciprocate the display unit in the same direction as the photosensitive medium for a predetermined distance.

The photosensitive medium may include a photosensitive belt which runs in a direction with a predetermined speed, and the reciprocating unit may drive the display unit in the same direction and with the same speed as the photosensitive belt.

The foregoing and/or other aspects and utilities of the present general inventive concept may also be achieved by providing a printing method, including forming an electrostatic latent image onto a photosensitive medium according to image data, using an image output from a display unit, and developing the electrostatic latent image on the photosensitive medium.

The forming of the electrostatic latent image may include driving the photosensitive medium to move at a predetermined speed, and forming a page unit of the electrostatic latent image onto the photosensitive medium by driving the display unit.

The forming of the page unit of electrostatic latent image may include increasing the driving velocity of the photosensitive medium until the electrostatic latent image area arrives at a developing zone.

The forming of the page unit of the electrostatic latent image may include forming the electrostatic latent image by driving image output pixels of the display unit.

A relationship between a length (X) of the display unit and a length (s) of the image may be expressed by a mathematical expression as follows:

$$X \geqq s.$$

The forming of the page unit of the electrostatic latent image may include forming the electrostatic latent image by driving image output pixels of the display unit by a plurality of stages and randomly.

A relationship between a length (X) of the display unit and a length (s) of the image may be expressed by a mathematical expression 2 as follows:

$$X \geqq [s+V_{B2}\times\Delta t\times(m-1)]$$

where $V_{B2}$ is a velocity of the photosensitive medium, $\Delta t$ is a delay time between random outputs, and m is a number of the random outputs.

The forming of the page unit of the electrostatic latent image may include forming the electrostatic latent image by driving image output pixels of the display unit in opposite direction to the driving direction of the photosensitive medium by a plurality of stages and randomly.

A relationship between a length (X) of the display unit and a length (s) of the image is expressed by a mathematical expression 3 as follows:

$$X \geqq s\times V_{B3}/(V_{B3}+V_D)$$

where $V_{B3}$ is the velocity of the photosensitive medium, and $V_D$ is the velocity at which the display unit is driven in an opposite direction to the photosensitive medium by stages.

The forming of the electrostatic latent image may include stopping driving the photosensitive medium, driving the display unit and forming an electrostatic latent image on the photosensitive medium in a standstill position, and moving the photosensitive medium bearing the electrostatic latent image to a developing zone.

The moving of the photosensitive medium bearing the electrostatic latent image may include moving the photosensitive medium at maximum velocity.

The driving of the display unit may include simultaneously driving image output pixels of the display unit to form the electrostatic latent image at the same time.

The driving of the display unit may include forming the electrostatic latent image by driving image output pixels of the display unit by a plurality of stages and randomly.

The driving of the display unit may include forming the electrostatic latent image by driving image output pixels of the display unit in opposite direction to the driving direction of the photosensitive medium by a plurality of stages and randomly.

The stopping of driving the photosensitive medium may include moving the display unit close to the photosensitive medium, and the driving of the display unit may include returning the display unit to an original position.

The forming of the electrostatic latent image may include driving the photosensitive medium with a predetermined speed, driving the display unit in the same direction as the photosensitive medium, and causing the display unit to form an electrostatic latent image while the display unit is driven.

The driving the display unit may include driving the display unit with the same speed as the photosensitive medium.

The foregoing and/or other aspects and utilities of the present general inventive concept can be achieved by providing a computer readable recording medium having embodied thereon a computer program to execute a method, wherein the method includes forming an electrostatic latent image onto a photosensitive medium according to image data, using an image output from a display unit, and developing the electrostatic latent image on the photosensitive medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
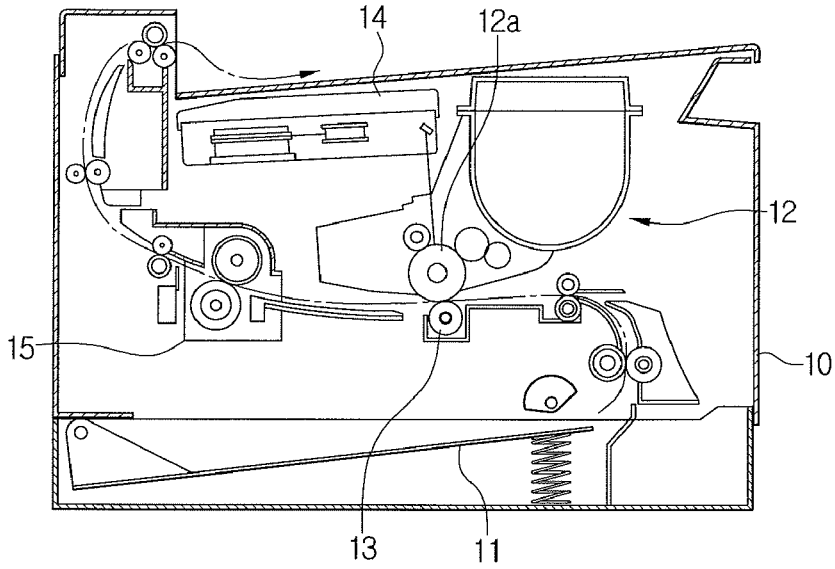
FIG. 1A (PRIOR ART)
FIG. 1A is a schematic diagram of a conventional monochromatic image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3A:
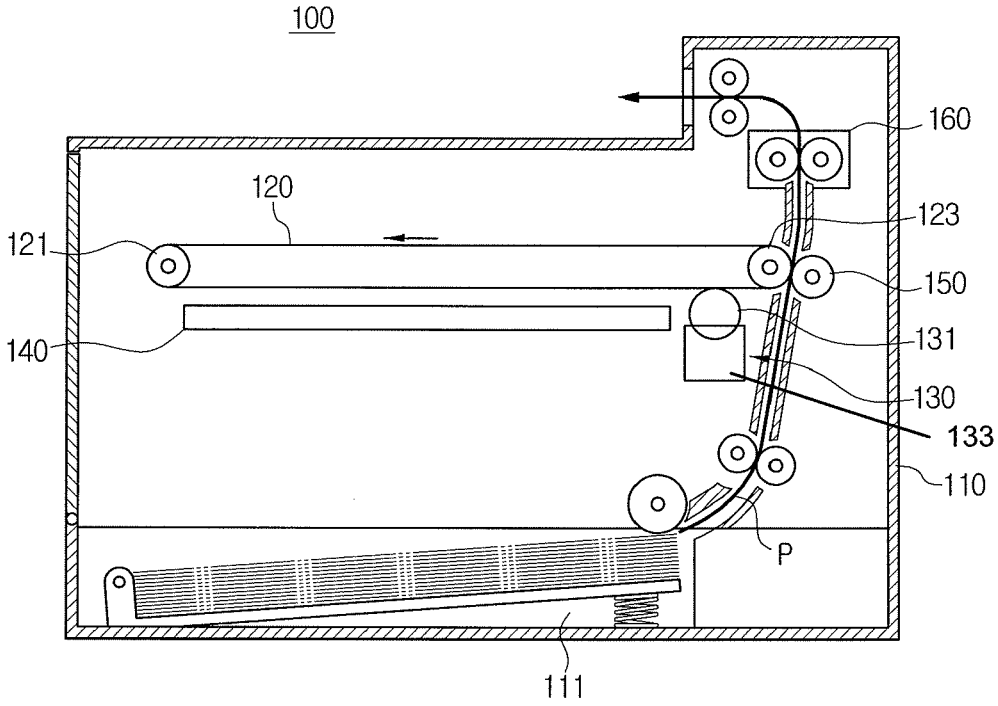
FIG. 3A is a view illustrating an image forming apparatus according to an embodiment of the present general inventive concept.

Referring to FIG. 3A, an image forming apparatus 100 according to an embodiment of the present general inventive concept may be of a monochromatic type, and includes a main body 110, a photosensitive medium 120 housed inside the main body 110, a developing machine 130, a display unit 140, a transfer roller 150 and a fusing unit 160. A paper feed unit 111 is provided at the lower part of the main body 110 to supply the printing medium ('paper').

The photosensitive medium 120 forms an image, and includes, according to one aspect of the present embodiment, a photosensitive belt running in one direction, on the support by a plurality of support rollers 121 and 123. The photosensitive belt 120 forms an image through the known processes such as electric charging, light exposure, image developing and image transfer. One of the support rollers 121 and 123 may be an idle roller or a tension roller, and the other are of the support rollers 121 and 123 may be a driving roller. The photosensitive belt 120 runs in one direction by the rotation of the driving roller 123.

The developing machine 130 may include a developing roller 131 and a developer reservoir 133 holding developer therein. The developing roller 131 supplies the developer, such as toner, to an electrostatic latent image region of the photosensitive belt 120 by contact, or, in a contactless manner. The operation and the structure of the developing machine 130 are already known in the art, and therefore, these will not be explained below for the sake of brevity.

The display unit 140 exposes the photosensitive belt 120 to light and thus forms an electrostatic latent image on the photosensitive belt 120. The display unit 140 may include a liquid crystal display, light emitting device, plasma display panel, and CRT. That is, the display unit 140 does not adopt a scanning operation like the known laser scanning unit (LSU), but it adopts pixel-based illumination, in which the photosensitive belt 120 to form the electrostatic latent image is exposed in one or more pixel units. Accordingly, the display unit 140 may be implemented as a plate which is positioned to correspond to a horizontal travel of the photosensitive belt 120. The display unit 140 may be at a distance from the photosensitive belt 120.

The transfer roller 150 may rotate in contact with the photosensitive belt 120. Therefore, the image of the photosensitive belt 120 is transferred onto a paper sheet P which is passed between the transfer roller 150 and the photosensitive belt 120. The paper sheet bearing the image is passed through the fusing unit 160 and then discharged out.

In the construction explained above, image data to print is transmitted from a host (for example, a computer or a printing driver) to the display unit 140. The image data may be passed through optical density adjustments suitable for printing, and may be output to the display unit 140. Because the photosensitive belt 120 is sensitive to optical density, it may be necessary to adjust the optical density by separate processing. For example, the photosensitive belt 120 may be exposed using at least one of the RGB color lights, or using R and G light, or R and B light, or G and B light. Additionally, the photosensitive belt 120 may be exposed using all of the R, G, B light. In certain circumstances, output values of R, G, B light can be adjusted appropriately to form the electrostatic latent image with appropriate electric charge on the photosensitive belt 120.

According to the output values of the display unit 140, or in consideration of possible interferences between neighboring pixels, the display unit 140 may be in contact with, or at a distance from the photosensitive belt 120, while the display unit 140 outputs light beam in response to the image data to form the electrostatic latent image on the photosensitive belt 120. When the display unit 140 is at a distance from the photosensitive belt 120, it is desirable to consider that the image may suffer contrast degradation or insufficient optical density, and therefore, the distance between the display unit 140 and the photosensitive belt 120 may be adjusted appropriately so as to avoid interference with the operation of the photosensitive belt 120 and also minimize interference-related problems. This can be done in the design state, by considering the amount of optical output of the display unit 140 and the characteristics of the photosensitive belt 120.

Figure 3B:
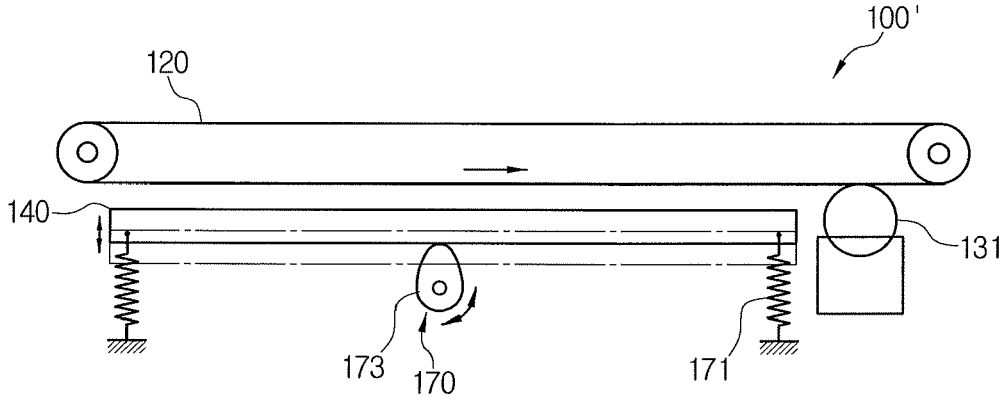
FIG. 3B is a view illustrating an image forming apparatus according to an embodiment of the present general inventive concept.

FIG. 3B is a view illustrating an image forming apparatus 100' according to an embodiment of the present general inventive concept. Referring to FIGS. 3A and 3B, the image forming apparatus 100, may additionally include a movable unit 170 which distances the display unit 140 away to minimize interference with the photosensitive belt 120, and then moves the display unit close to the photosensitive belt 120 for exposure. The movable unit 170 may include a pressure member 171 which biases the display unit 140 to move away from the photosensitive belt 120, and a cam member 173 which forces the display unit 140 close to the photosensitive belt 120. The pressure member 171 may include at least one tension spring, and the cam member 173 may forcibly move the display unit 140 through its reciprocation by the rotation of a driving motor (not illustrated). To this end, the display unit 140 may be provided inside the image forming apparatus 100' so as to move a predetermined distance, and move reciprocally by a guide member (not illustrated).

In alternative examples, an actuator, such as solenoid, may be used to move the display unit 140. The actuator may directly move the display unit 140 or move the cam 173 to bias the display unit 140 toward the photosensitive belt 120.

The printing operation, and especially the exposure by the display unit 140, in the image forming apparatus 100 according to the present embodiment will be explained below.

Figure 4A:
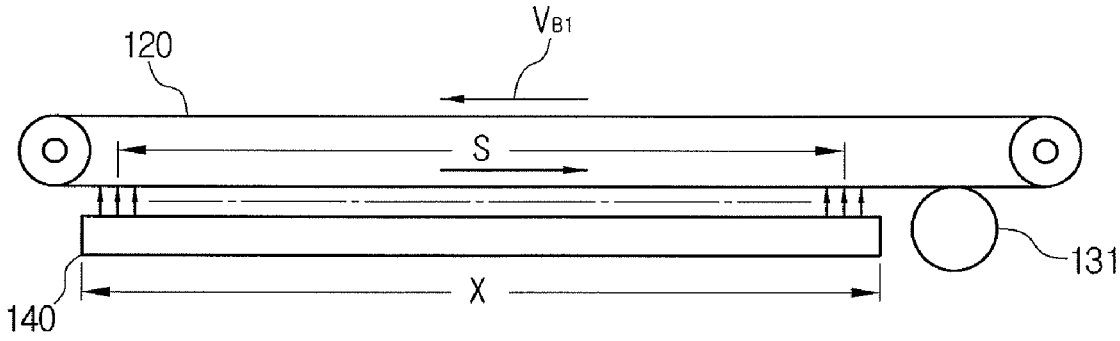
FIGS. 4A and 4B are views illustrating a printing method of an image forming apparatus according to an embodiment of the present general inventive concept.
Figure 4B:
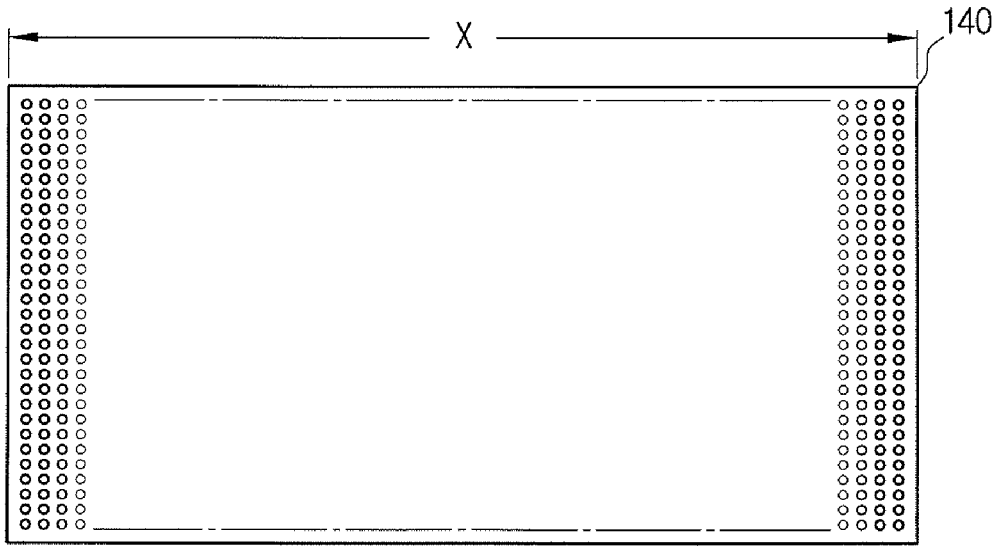

The image forming apparatus 100 may expose the photosensitive belt 120 using the following printing methods:

In a first printing all pixels of the display unit 140, that correspond to the input image data, are illuminated, during the running of the photosensitive belt 120 with speed $V_{B1}$ (FIGS. 4A and 4B). The pixels are disposed on a surface of the display unit 140 to face the 140 in the direction. This method is used especially when the value of the light output from the display unit 140 is bright enough to expose the photosensitive belt 120 regardless of the running speed thereof, and can be done in the design stage, by using advanced technologies related with the display unit 140 and adjusting the speed of the photosensitive belt 120 to correspond to the output value. The pixels of the display unit 140 may all be illuminated to simultaneously expose the photosensitive belt 120 with the output light corresponding to the pixels. A printer resolute of a printed image from the formed latent image relates the number of pixels.

In the above case, exposure time may be decreased to complete the formation of the latent image, because the display unit 140 carries out exposure relative to the photosensitive belt 120 by a unit of an entire page. Accordingly, after the exposure, the speed of the photosensitive belt 120 can be increased to exceed $V_{B1}$ until the electrostatic latent image region reaches the developing roller 131. As a result, the printing processing, especially from exposure to developing, is speeded up, and a printing operation faster than the conventional printing operation, using LSU, is provided.

The time (t1) to form an image by the first printing method can be expressed as follows:

$$t1=s/V_{B1} \quad \text{[Equation 1]}$$

where 's' is the traveling distance of the photosensitive belt 120, and VB1 is the speed of the photosensitive belt 120.

Accordingly, when the leading end of the image formation region of the photosensitive medium (that is, photosensitive belt 120) reaches the position corresponding to the display unit 140, the image may be instantly formed by the display unit 140.

As expressed in equation 1, with this printing method, there is no need to provide a separate time interval to expose the photosensitive belt 120, as in the conventional LSU which determines the exposure time interval according to the rotational velocity of the polygon mirror driving motor, driving speed of the photosensitive medium, or the like. As a result, $V_{B1}$ can be increased sufficiently. Because $V_{B1}$ can be increased without limit according to the photosensitive characteristics of the photosensitive belt 120 or the light outputs of the display unit 140, the printing time can be decreased.

The size of the display unit 140, that is, the length in the traveling direction of the photosensitive belt 120, may be equal to, or larger than 's'. In other words, when it is assumed that the length of the final image is 's', the basic length X of the display unit 140 according to the present embodiment of the present invention can be expressed as $X \geqq s$ .

Figure 5A:
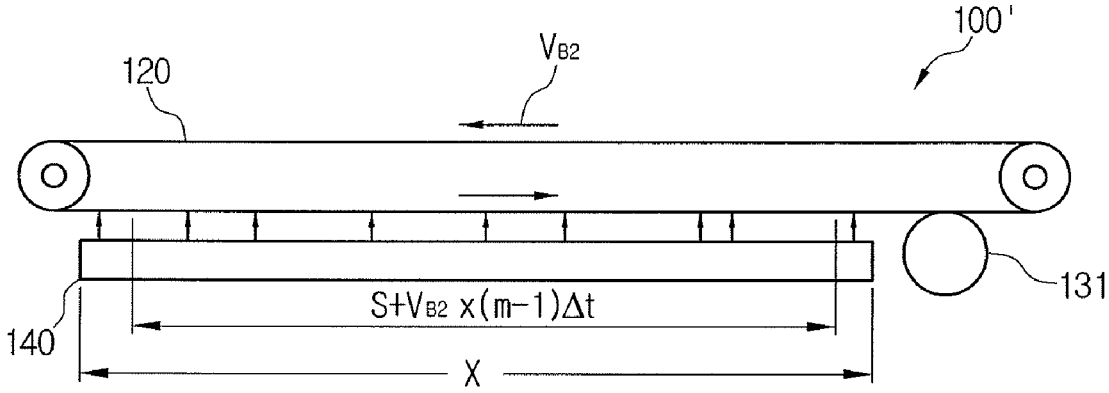
FIGS. 5A and 5B are views illustrating a printing method of an image forming apparatus according to an embodiment of the present general inventive concept.
Figure 5B:
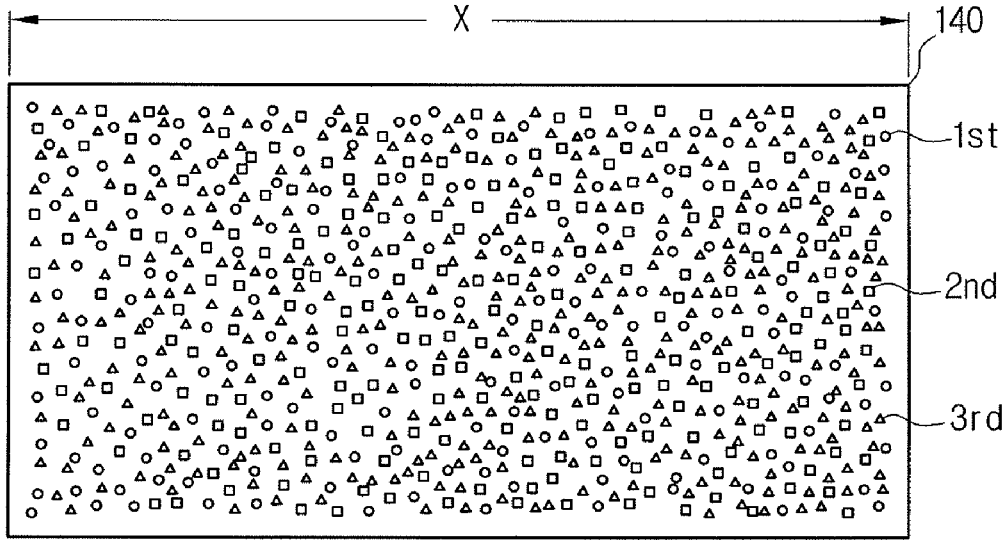

In the second printing methods the photosensitive belt 120 is driven at velocity (or speed) $V_{B2}$ as illustrated in FIGS. 5A and 5B. In order to expose the photosensitive belt 120, the display unit 140 outputs segments of the image data in series and in random order. More specifically, as illustrated in FIG. 5B, pixels indicated in circles output first light as a first segment of the image data, pixels in squares output second light as a second segment of the image data, and the pixels in triangles output third light as a third segment of the image data, to thus form an electrostatic latent image on the photosensitive belt 120. Although this embodiment carries out exposure by three stages, this should not be construed as limiting, as this is a matter of design and thus the number of stages can be varied appropriately. Because the display unit 140 outputs light corresponding to the image in multiple stages, interference of light between neighboring pixels can be minimized. Also in this example, considering a possible delay between the first, the second and the third light outputs, it is necessary to delay the output of image data accordingly. A composite result of the first, second, and third outputs should exactly match an original image of the first printing method illustrated in FIGS. 4A and 4B. However in the second printing method of FIGS. 3A and 3B, the original image may be distorted when it is directly formed to an electrostatic latent image due to a minute time difference Δt. In order to prevent such distortion of the image, the first, the second and the third light may be sequentially output at successive distances $V_{B2}\times\Delta t$ downstream from the previous output. Accordingly, in the case of outputting the light by three stages as in the present example of three stages, the second image is output $V_{B2}\times\Delta t$ downstream from the original position, and the third image is output $V_{B2}\times\Delta t\times 2$ downstream from the original position, such that the resultant electrostatic latent image can match the original image. Accordingly, the display unit 140 having the basic length s may be extended by an additional length of $V_{B2}\times\Delta t\times 2$ to enable such outputs. In other words, when the random outputs are carried out in (m) stages, an additional length of $V_{B2}\times\Delta t\times(m-1)$ is necessary. Assuming that the length of the final image is s, the basic length X of the display unit 140 satisfies $X \geqq \{s+V_{B2}\times\Delta t\times(m-1)\}$, where m is the number of random outputs, and Δt is the delay interval between the output stages.

As mentioned above, the light is output from the display unit 140 by multiple stages, but successively and within a short period of time. Therefore, there may be no substantial difference between the exposure time of the first and the second printing methods. Additionally, in the second method, the overall printing can be carried out faster than the conventional system which uses the LSU for the exposure process, by driving the photosensitive belt 120 at a high speed.

Figure 2:
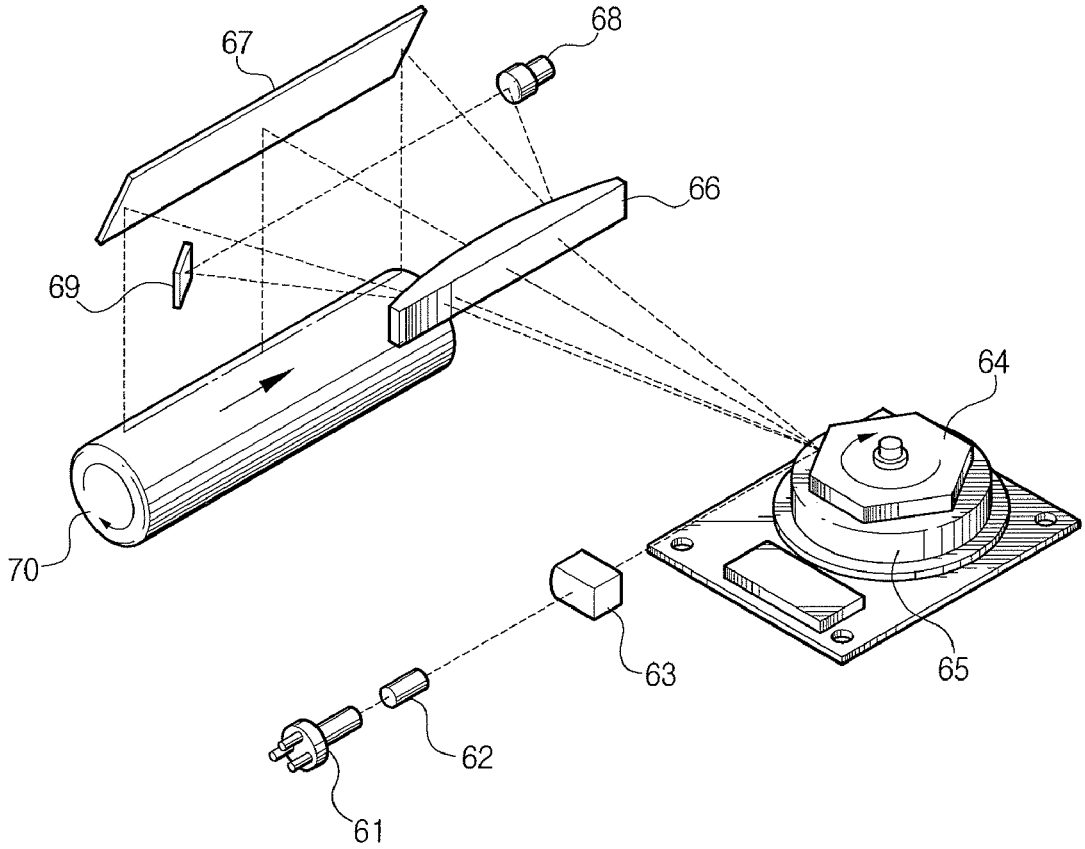
FIG. 2 (PRIOR ART)
FIG. 2 is a schematic perspective view of a conventional laser scanning unit (LSU)

The printing time t2 of the second method can be expressed as follows:

$$t2=[s/V_{B2}+(m-1)\Delta t] \quad \text{[Equation 2]}$$

where m is the number of random outputs, and Δt is a delay interval between the outputs. When the same conditions are imposed in the second method as in the first method, a time increase is expected in the second method due to (m−1)Δt, but this increase can be offset by sufficiently increasing the velocity $V_{B2}$ and sufficiently decreasing the time difference Δt. Therefore, there is no significant difference between the first and second printing methods. As a result, compared to a conventional system which uses a LSU such as that of FIG. 2, the printing time can be greatly reduced.

Figure 6A:
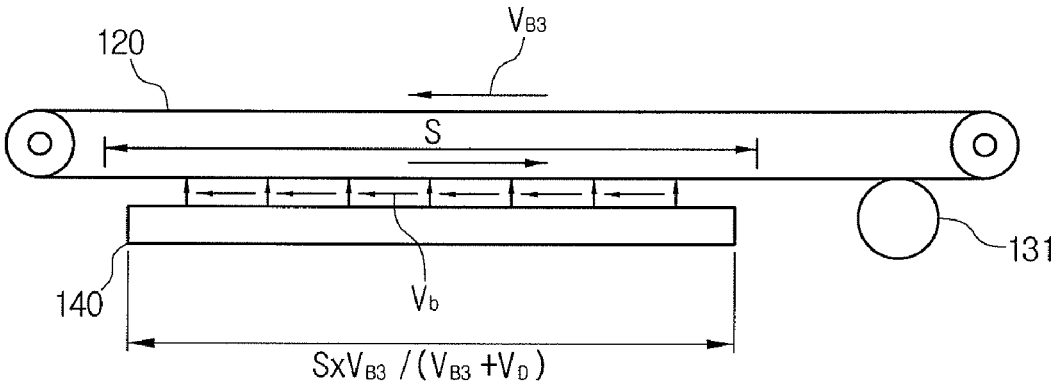
FIGS. 6A and 6B are views illustrating a printing method of an image forming apparatus according to an embodiment of the present general inventive concept.
Figure 6B:
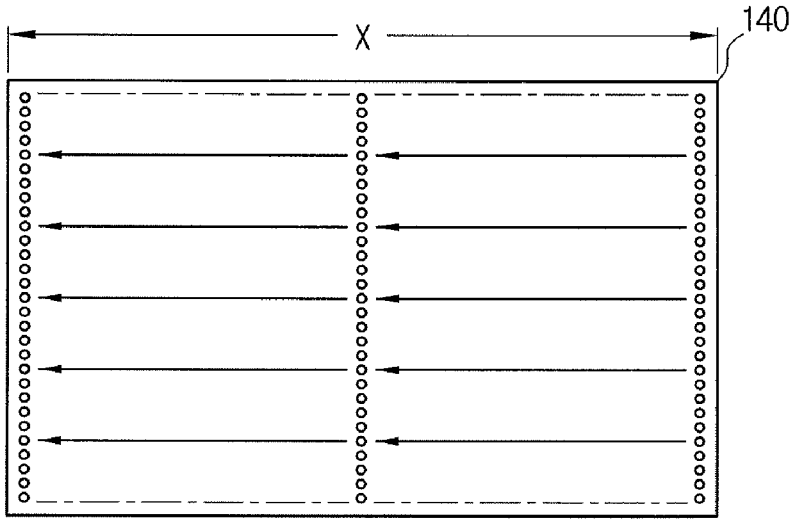

Referring to FIGS. 6A and 6B, in the third printing method, the photosensitive belt 120 is driven at the velocity of $V_{B3}$, and the display unit 140 outputs light to the photosensitive belt 120 in a pattern moving the direction opposite to the motion of the photosensitive belt 120 and with the pattern in multiple stages. That is, pixels of each segment are spaced in a direction and operate in order, in the direction from one side to the other side within the segment. Because the velocity $V_D$ of scanning light in the opposite direction is combined with (vectorially added to) the speed $V_{B3}$, the time to expose an area of the photosensitive belt 120 can be decreased.

The printing time t3 of the third printing method can be expressed as follows:

$$t3=s/(V_{B3}+V_D) \quad \text{[Equation 3]}$$

Regarding $V_D$, because the light output from the display unit 140 is moving against the forward movement of the photosensitive belt 120, light exposure time is decreased due to the counter-speed of the light from the display unit 140 with respect to the photosensitive belt 120. As a result, the printing time can be decreased. In this case, the size of the display unit 140 in the forward movement of the photosensitive belt 120 can be decreased. In other words, assuming that the length of the final image is 's', a basic length of the display unit 140 required for the third printing method may be reduced by $X \geqq s\times V_{B3}/(V_{B3}+V_D)$. The output from the display unit 140 may be carried out in series, in a line unit or lines of light, or in a random manner.

Figure 7A:
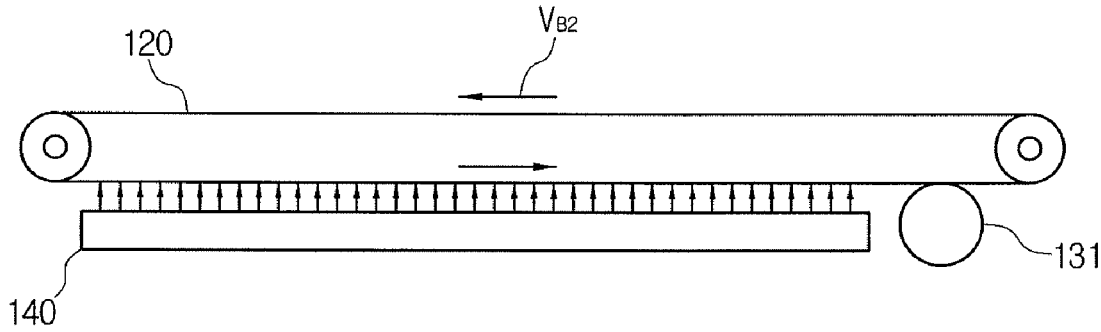
FIGS. 7A and 7B are views illustrating a printing method of an image forming apparatus according to an embodiment of the present general inventive concept.
Figure 7B:
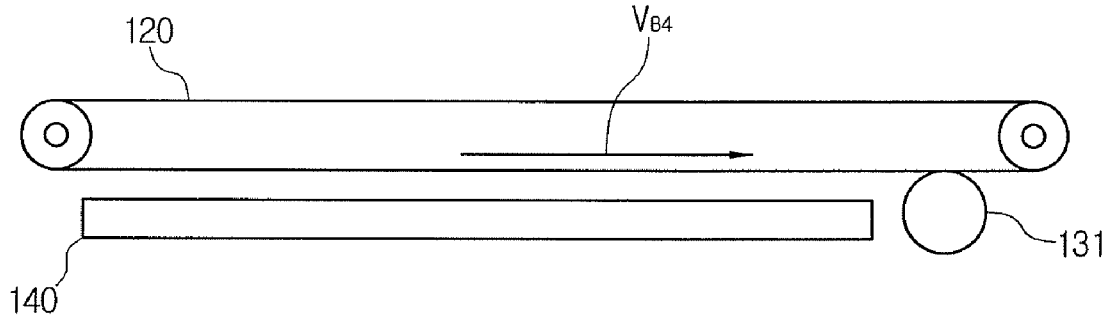

Referring to FIGS. 7A and 7B, in the fourth printing method the photosensitive belt is divided by exposure time from the photosensitive belt operating time. As illustrated in FIG. 7A, the display unit 140 is driven to expose the photosensitive belt 210 as a page unit, and in this state, the photosensitive belt 120 is still at a position. As illustrated in FIG. 7B, when the light exposure is completed, the photosensitive belt 120 is moved with a fourth speed $V_{B4}$ to the developing zone where the developing roller 131 is positioned. The speed $V_{B4}$ of the photosensitive belt 120 may be controlled to be faster than the previously described velocity (or speed) $V_{B1}$, $V_{B2}$, or $V_{B3}$.

An image forming time t4 can be expressed by the following:

$$t4=s/V_{B4}+t^* \quad \text{[Equation 4]}$$

where t* is the time necessary for the light exposure while the photosensitive belt 120 is holding still.

Because the fourth velocity $V_{B4}$ is not related with the exposure speed of the photosensitive belt 120, it can be increased up to the maximum speed of the system. For example, $V_{B4}$ may be increased up to the maximum speed of the motor. As a result, t4 is smaller than the conventional printing time (t0=s/Vo, where Vo is velocity of the photosensitive medium or belt, s is traveling distance, or data realization length of original image, of the photosensitive medium or belt). In other words, by setting t* to satisfy $t^*<(S/V_0-s/V_{B4})$, printing time can be reduced from using the conventional LSU. The fourth printing method can thus provide advantages such as setting the photosensitive medium to high speed, without being limited by the other components, while completely forming the image, and consequently reducing printing time.

The fifth printing method partially adopts the photosensitive belt exposing manner of the fourth methods. That is, instead of completely exposing the photosensitive belt 120 as in the fourth method, the fifth method performs exposure by multi-stages as in the second method of FIGS. 5A and 5B. This method can also shorten the time t* necessary for exposure, by the photosensitive characteristics of the photosensitive belt 120 and the light outputs of the display unit 140. Therefore, the printing time can be reduced to be shorter than the conventional system, and when considering the on-going advancements of this area, the speed is expected to be further reduced.

The sixth printing method partially adopts the exposure manner of the third and the fourth methods. That is, the sixth printing method drives the display unit 140 while the photosensitive belt 120 is still (as in the fourth method), and outputs the light against the forward movement of the photosensitive belt 120 as in the third method (scanning mode). Like the above printing methods, the sixth printing method can shorten the driving time for the exposure of the photosensitive belt 120 by the display unit 140, and the printing time can be reduced.

As discussed above regarding the printing methods, the printing time can be greatly decreased compared to the conventional system, and a high-speed printer can be provided.

Additionally, the pixels of the display unit 140, such as LCD or PDP type, can be fixed in their critical positions in the fabricating stage, and managed with high precision. The pixels are in fixed positions, and when viewed in terms of the line unit, the pixels in a leading end and pixels in a tail end of the display unit 140 output light almost at the same time. As a result, image distortion or skew, which are frequently caused by the movement of the photosensitive belt 120, can be prevented. That is, because the much decreased image forming time as compared to conventional systems basically removes the possibility of image distortion, so that separate effort or control to solve such a problem is unnecessary.

According to the embodiment of the present general inventive concept, abnormal irregularity of image density can be minimized. This will be explained below with reference to a conventional example which incorporates a drum type photosensitive medium. One line unit of image data is focused on the photosensitive drum from a laser scanning unit (LSU). The photosensitive drum may be formed to a circular configuration. When it is assumed that the scanning speed of the LSU and the velocity of the photosensitive drum are controlled to constant, the circular configuration of the photosensitive drum allows the image data to be scanned to an electrostatic image of one line unit at regular intervals. This will be explained in greater detail in FIG. 8A which illustrates a rough surface of the photosensitive drum in solid line, and an ideal circle in phantom line. For convenience of explanation, it is assumed that the plus-variation is the greatest at 90 degrees, and the minus-variation is the greatest at 270 degrees. The linear velocity at 90 degrees on the photosensitive drum 1 is the fastest by $(r+\delta max)\times w$. The linear velocity at 270 degrees is the slowest by $(r-\delta max)\times w$. Because the one-line scan speed of the LSU is constant, intervals between lines at 90 degrees are wider than designed distances. Accordingly, image is formed with lower density at 90 degrees. On the contrary, because intervals between the lines are narrower than designed distances, image is formed at 270 degrees with higher density. The photosensitive drum is sized such that it has generally a circumference shorter than the length of one page, and accordingly, the final image on a unit page would have images of high and low densities in alternate fashion. This will cause an image of alternating dark and lighter areas, and image quality is degraded.

The belt-type photosensitive medium has a similar problem. In the case of photosensitive belt, the image degradation is mainly caused by phase variations of driving and driven rollers of the photosensitive belt. However, with the display unit 140, in which the critical positions of the pixels are fixed at manufacture, image density can be managed with high precision. Depending on the characteristics of the photosensitive belt, an electrostatic latent image may be formed on the photosensitive belt in a moving state, or a standstill state, such that the electrostatic latent image formation time (exposure time) t* approaches zero (0). Accordingly, the leading and tail ends of the image are influenced by the speed of the photosensitive belt 120 almost at the same time. Because the time to form the entire image can be decreased to be shorter than the time when using the conventional LSU, the electrostatic latent image in pixel unit formed on the photosensitive belt 120 can be formed without substantial influences from the photosensitive belt 120 or the driving components, and as a result, abnormally irregular density of an electrostatic latent image due to speed variation over respective regions of the photosensitive belt 120 can be avoided.

Figure 9:
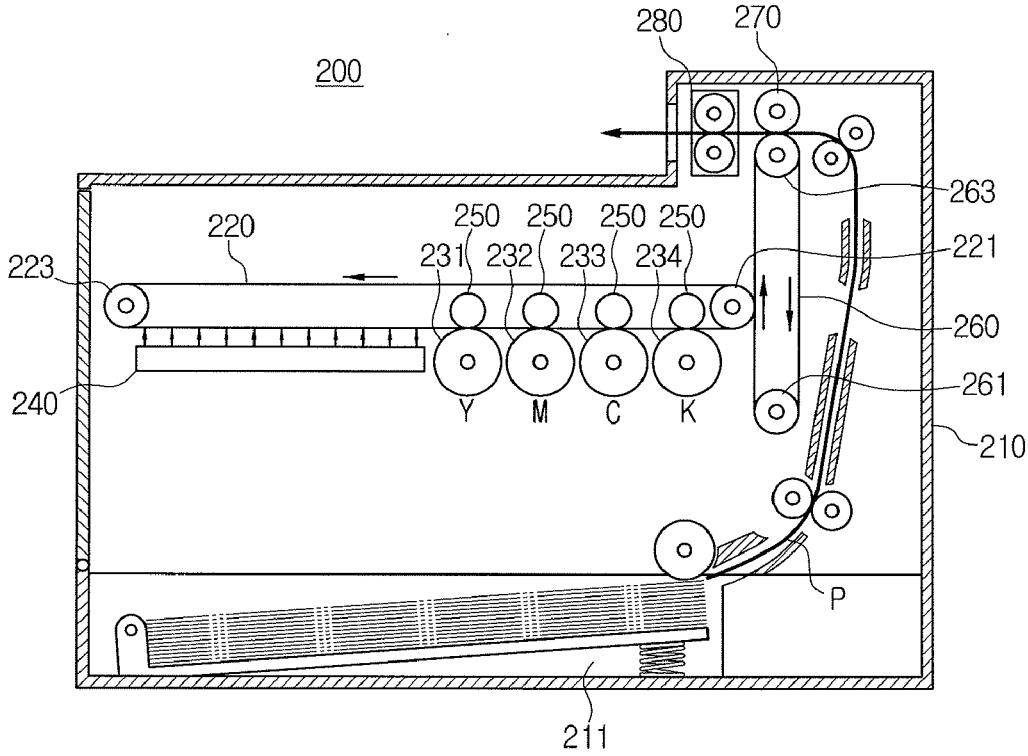
FIG. 9 is a view illustrating an image forming apparatus according to an embodiment of the present general inventive concept.

Referring now to FIG. 9, which illustrates an image forming apparatus 200 according to an embodiment of the present general inventive concept, the image forming apparatus 200 is exemplified as a multi-pass color image forming apparatus, which includes a main body 210, a photosensitive belt 220 housed in the main body 210, color developing rollers 231, 232, 233, 234, a display unit 240 to expose the photosensitive belt 220, first transfer rollers 250, an intermediate transfer belt 260 and a second transfer roller 270.

The main body 210 surrounds a feed part 211 to supply paper sheets, and a fixing part 280 to fix the transferred image onto the printing medium.

The photosensitive belt 220 has the same structure as the photosensitive belt 120 explained above with reference to FIG. 3A, which is movably supported on the driving roller 221 and the driven roller 223 to move in one direction.

The color developing rollers 231, 232, 233, 234 are arranged in turn along the movement direction of the photosensitive belt 220, and each forms an individual color image onto the photosensitive belt 220. First transfer rollers 250 are disposed on the inner side of the photosensitive belt 220 in tandem with the color developing rollers 231, 232, 233, 234.

The display unit 240 forms page units of electrostatic image onto the photosensitive belt 220 either at once, or by stages. The structure and operation of the display unit 240 are similar to those of the display unit 140 as explained above with reference to FIGS. 3A and 3B, and, for the sake of brevity, will not be explained below.

The intermediate transfer belt 260 is supported by a plurality of supporting rollers 261 and 263 and held in contact with the photosensitive belt 220, and moves in one direction (indicated by arrows). The intermediate transfer belt 260 receives a series of color images of the color developing rollers 231, 232, 233, 234 such that the color images are superimposed on one another.

The final color image on the intermediate transfer belt 260 is then transferred onto a printing medium P which is passed between the intermediate transfer belt 260 and the second transfer roller 270 rotating in intimate contact with the intermediate transfer belt 260.

The printing medium with the final color image is passed through the fixing part 280 and then discharged out.

In the multi-pass image forming apparatus 200 constructed as described above, individual Y, M, C and K color images are formed by four rotations of the photosensitive belt 220, and compositely formed onto the intermediate transfer belt 260 in series. In order to form the individual color image, the display unit 240 is also driven four times to expose the photosensitive belt 220 to each page unit. In other words, the multi-pas image forming apparatus 200 repeats one-page printing operation of a monochromatic image forming apparatus such as 100 of FIG. 3A, four times over.

Figure 1B:
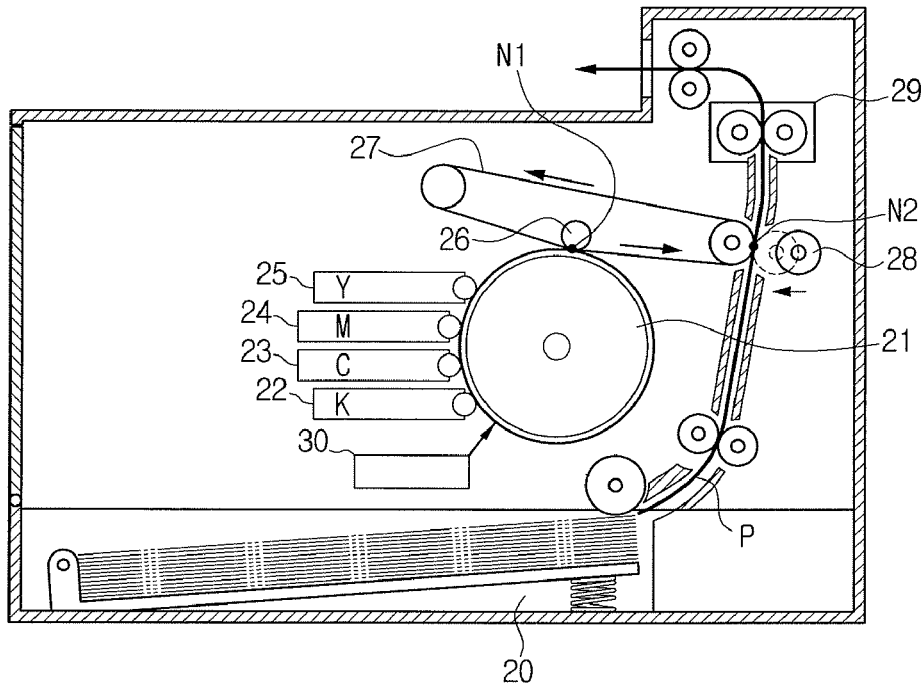
FIG. 1B (PRIOR ART)
FIG. 1B is a schematic diagram of a conventional multipass image forming apparatus.

The four times or phases of the image forming process to form individual color images may use any one of printing methods (1) to (6) illustrated above with reference to FIGS. 4A to 7B. Accordingly, the printing time of the multi-pass image forming apparatus 200 is decreased to become shorter than the multi-pass image forming apparatus of FIG. 1B which uses the conventional LSU.

In addition to the advantage of decreased printing time, the image forming apparatus 200 according to the third exemplary embodiment can provide the same advantages provided by the first exemplary embodiment.

Figure 8A:
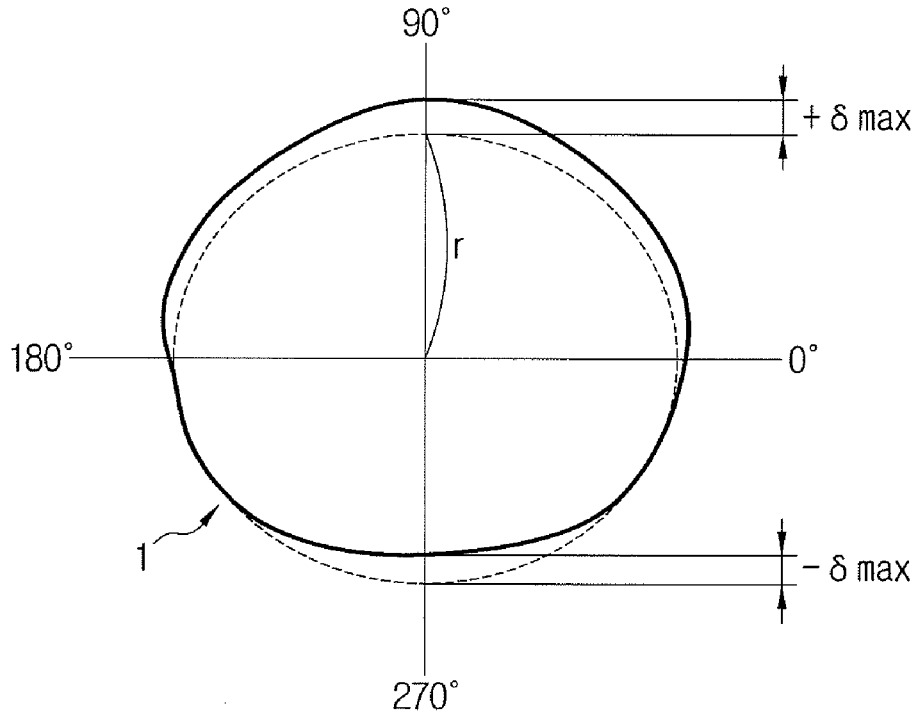
FIGS. 8A and 8B are views illustrating a phase variance due to precision error in a conventional photosensitive medium.
Figure 8B:
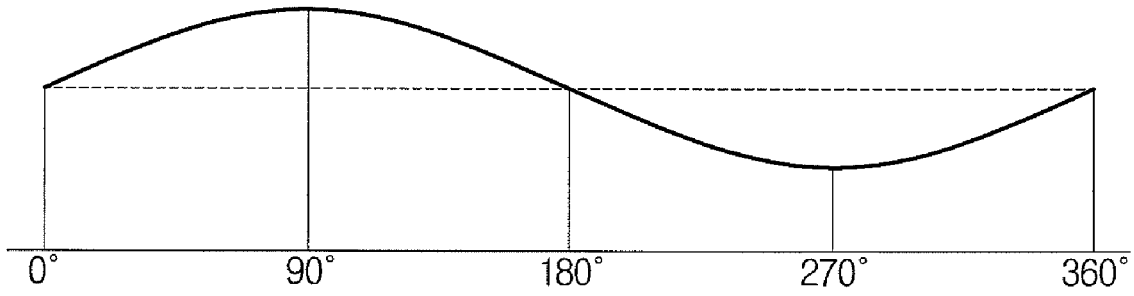

Meanwhile, the multi-pass image forming apparatus 200 may have drawbacks of the type that are explained with reference to FIGS. 8A and 8B. One of the drawbacks is that the image forming apparatus 200 may inherently acquire a degraded color image as the four colors of individual images are superimposed on one another on the intermediate transfer belt 260. A control technology of high complexity is required to solve such undesirable image degradation in a multi-pass type image forming apparatus and the same Applicant has proposed the "Roller, method of fabricating roller, a driving unit of an image forming apparatus, and an image forming apparatus" in Korean Patent application No. 10-2005-0043735 filed May 24, 2005, the entire disclosure of which is incorporated herein by reference as non-essential material. The problems as illustrated in FIGS. 8A and 8B cause irregular densities of the unit color images, and then cause ripples over all of the final color image. As a result, image quality degrades.

With the image forming apparatus 200 according to the third exemplary embodiment of the present invention, because the leading and tail ends of the electrostatic latent image are formed by the display unit 240 almost at the same time as explained in the first exemplary embodiment, the conventional problems are basically solved.

Figure 10:
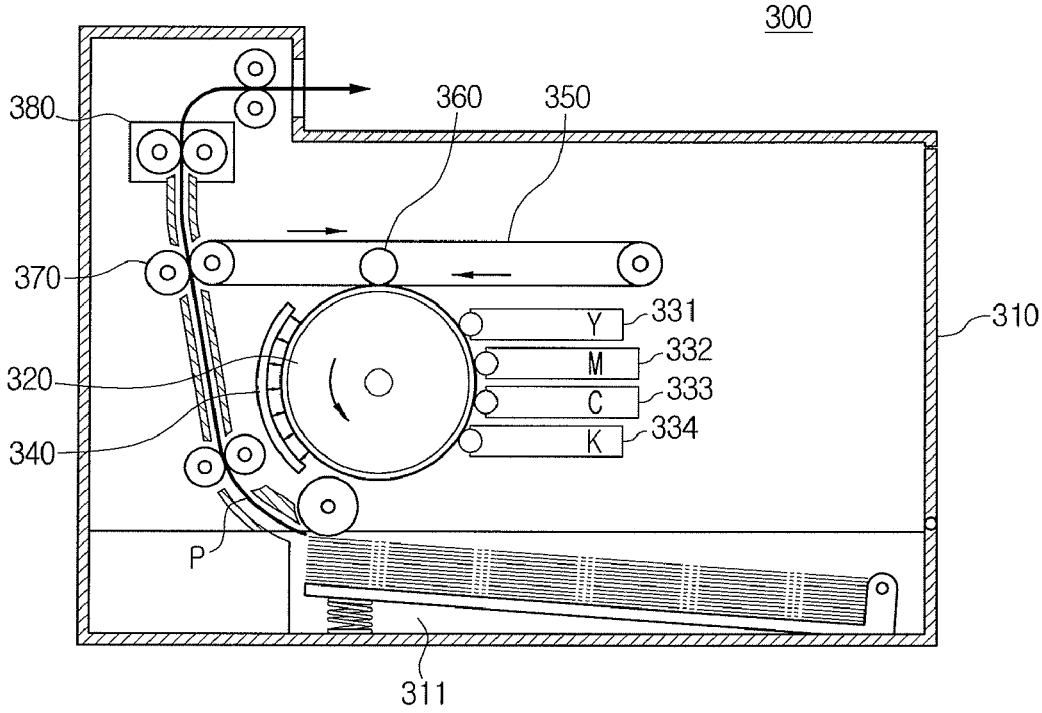
FIG. 10 is a view illustrating an image forming apparatus according to an embodiment of the present general inventive concept.

Additionally, with reference to FIG. 10, the image forming apparatus 300 according to the fourth exemplary embodiment of the present invention includes a photosensitive drum 320 house inside the main body 310, color developing machines 331, 332, 333, 334 arranged in turn in rotational direction of the photosensitive drum 320, a display unit 340, an intermediate transfer belt 350, a first transfer roller 360 and a second transfer roller 370.

A paper feed part 311 and a fixing part 380 are housed inside the main body 310.

In this embodiment, the photosensitive drum 320 takes the place of the photosensitive belt 240 of FIG. 9. The photosensitive drum 320 rotates four times, during which the unit color images are formed by the developing machines 331, 332, 333, 334 and transferred sequentially onto the intermediate transfer belt 350.

The color developing machines 331, 332, 333, 334 are arranged in turn in the rotational direction of the photosensitive drum 320, and moved by a driving means (not illustrated) close to, or away from the photosensitive drum 320. Accordingly, the color developing machines 331, 332, 333, 334 are driven individually to form respective unit color images onto the photosensitive drum 320.

The display unit 240 may have the curved surface that corresponds to the outer circumference of the photosensitive drum 340 so that the display unit 340 can expose the light of a page unit of image onto the photosensitive drum 340. The display unit 340 may be moved close to, or away from, the photosensitive drum 320 by a driving means (not illustrated). The display unit 340 may include a flexible liquid crystal display (LCD).

The intermediate transfer belt 350 receives a series of unit color images from the photosensitive drum 320, and transfers the full color image, in which the unit color images are superimposed on one another, onto the printing medium. The first transfer roller 360 is disposed on an inner side of the intermediate transfer belt 350 to correspond to the photosensitive drum 320.

The image forming apparatus 300 constructed as above according to the fourth exemplary embodiment of the present invention is a multi-pass type image forming apparatus using a drum type photosensitive medium, and the operations and effects thereof are similar to those of the image forming apparatus 200 of the third exemplary embodiment best illustrated in FIG. 9. Therefore, detailed explanations thereof will be omitted for the sake of brevity.

Figure 1C:
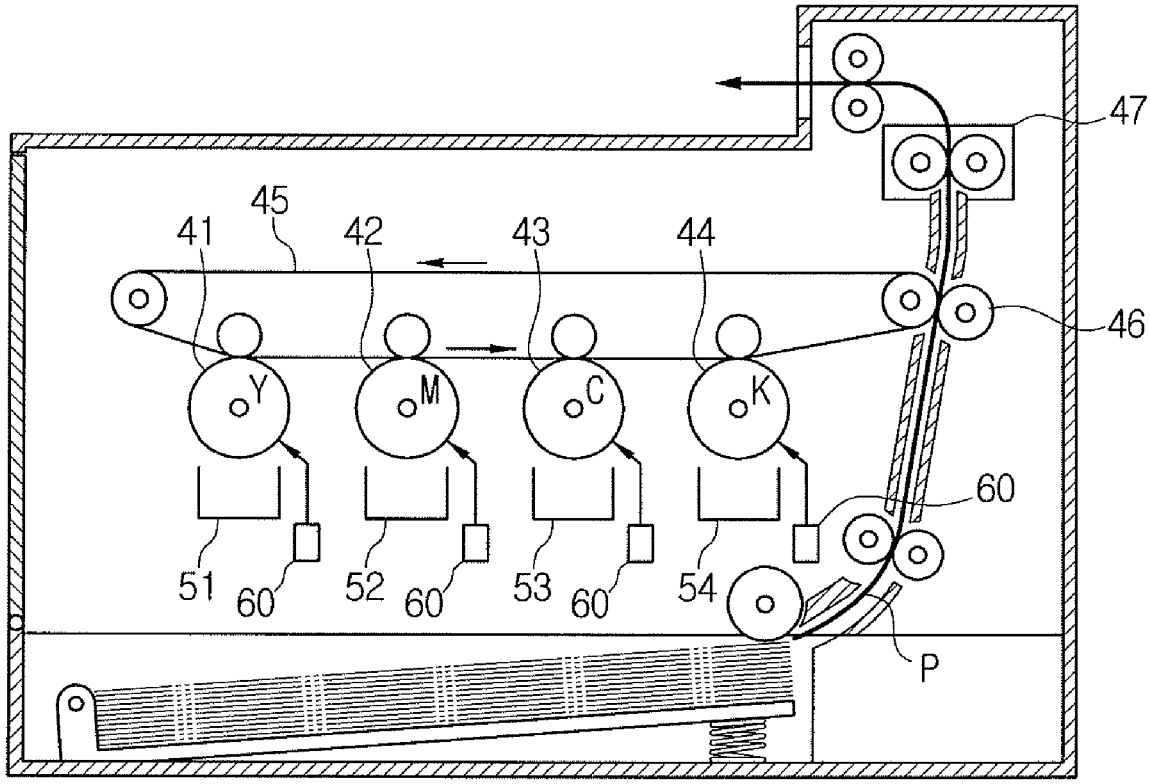
FIG. 1C (PRIOR ART)
FIG. 1C is a schematic view of a conventional single-pass image forming apparatus.
Figure 11:
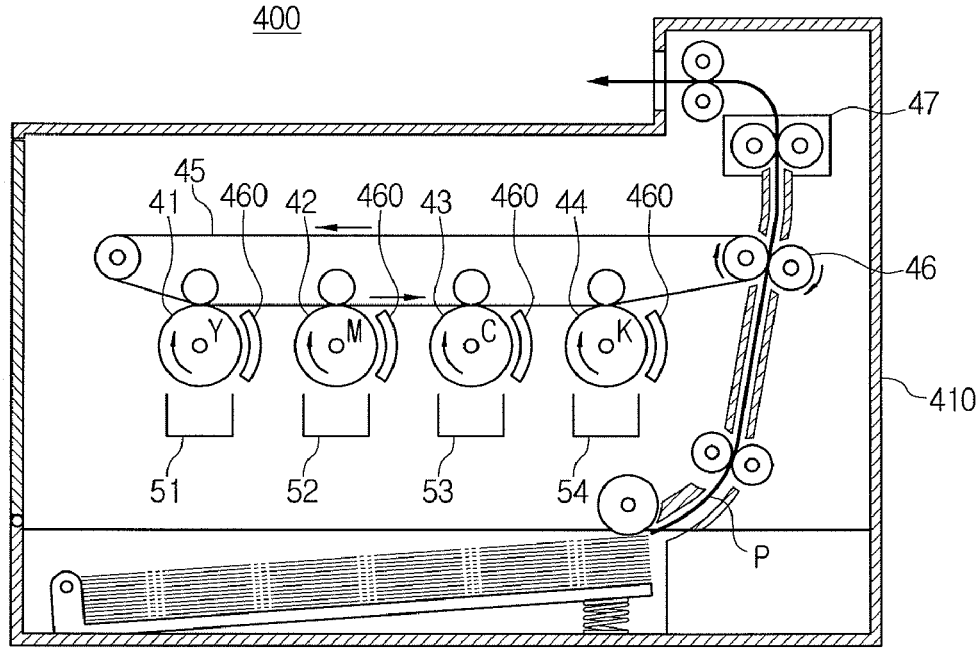
FIG. 11 is a view illustrating an image forming apparatus according to an embodiment of the present general inventive concept.

Referring to FIG. 11, an image forming apparatus 400 according to the fifth exemplary embodiment of the present invention employs a single pass type image forming apparatus. According to the fifth exemplary embodiment, display units 460 are disposed in tandem with the color photosensitive drums 41, 42, 43, 44 instead of the LSU 60. The same, or like, elements of FIGS. 1C and 11 are referred to by the same reference numerals, and explanations thereof will be omitted for the sake of brevity.

According to the construction of FIG. 11, the display units 460 that are disposed in tandem with the color developing drums 41, 42, 43, 44 output image exposure light so that electrostatic images are formed on the color developing drums 41, 42, 43, 44. The electrostatic latent images are developed by the developing units 51, 52, 53, 54, sequentially transferred and superimposed on the surface of the transfer belt 45, transferred onto a printing medium, and released. The display units 460 corresponding to the photosensitive drums 41, 42, 43, 44 have the same construction and operation as the display unit 340 as illustrated in FIG. 10, and thus, the detailed explanations thereof will be omitted for the sake of brevity.

The image forming apparatus 400 according to the fifth exemplary embodiment of the present invention provides a shorter printing time in which the color developing drums 41, 42, 43, 44 form a color image, than the image forming apparatus using the conventional LSU. This is because the exposure time of the display units 460 is reduced, and the photosensitive drums 41, 42, 43, 44 are rotated to the developing zone at a faster velocity.

Again, the fifth exemplary embodiment can provide the same advantages as mentioned in the first through fourth exemplary embodiments.

Figure 12:
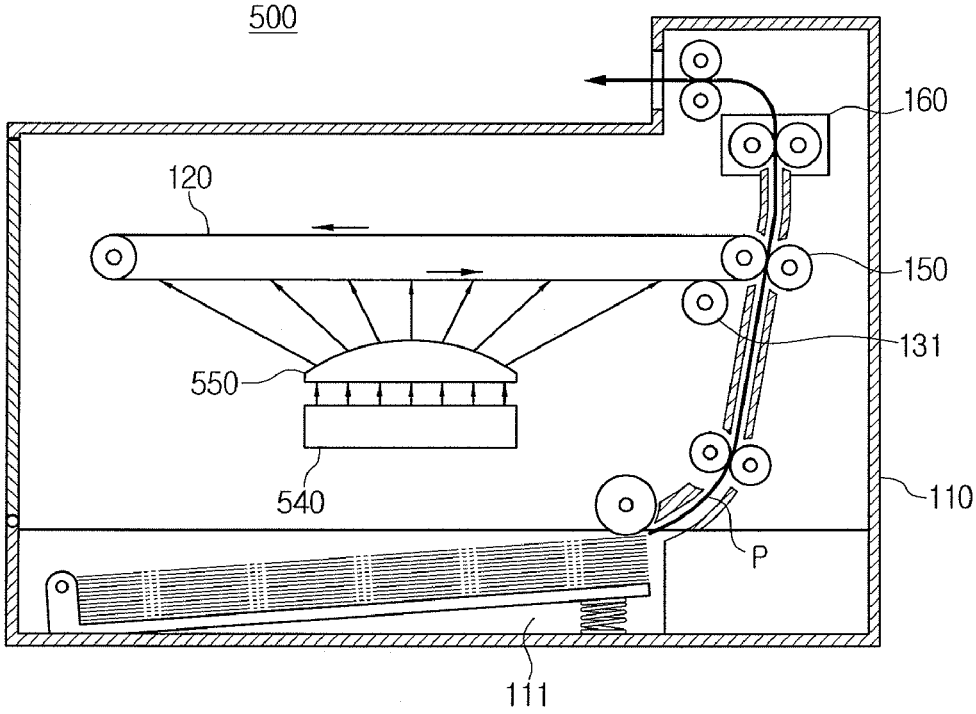
FIG. 12 is a view illustrating an image forming apparatus according to an embodiment of the present general inventive concept.

With reference to FIG. 12, an image forming apparatus 500 according to a sixth exemplary embodiment has the unique feature that the image forming apparatus 500 further includes a lens 550 between the display unit 540 and the photosensitive belt 120. The same, or like elements of FIGS. 3A and 12 are referred to by the same reference numerals.

The lens 550 guides the light emitted from the display unit 540 such that the light is focused on the photosensitive belt 120 in the regular size and optical density. With the use of the lens 550, the size of the display unit 540 can be reduced, or the positions of the display unit 540 can be changed freely. The lens 550 may be implemented in the same body as the display unit 540, or may be employed as a separate component.

Figure 13:
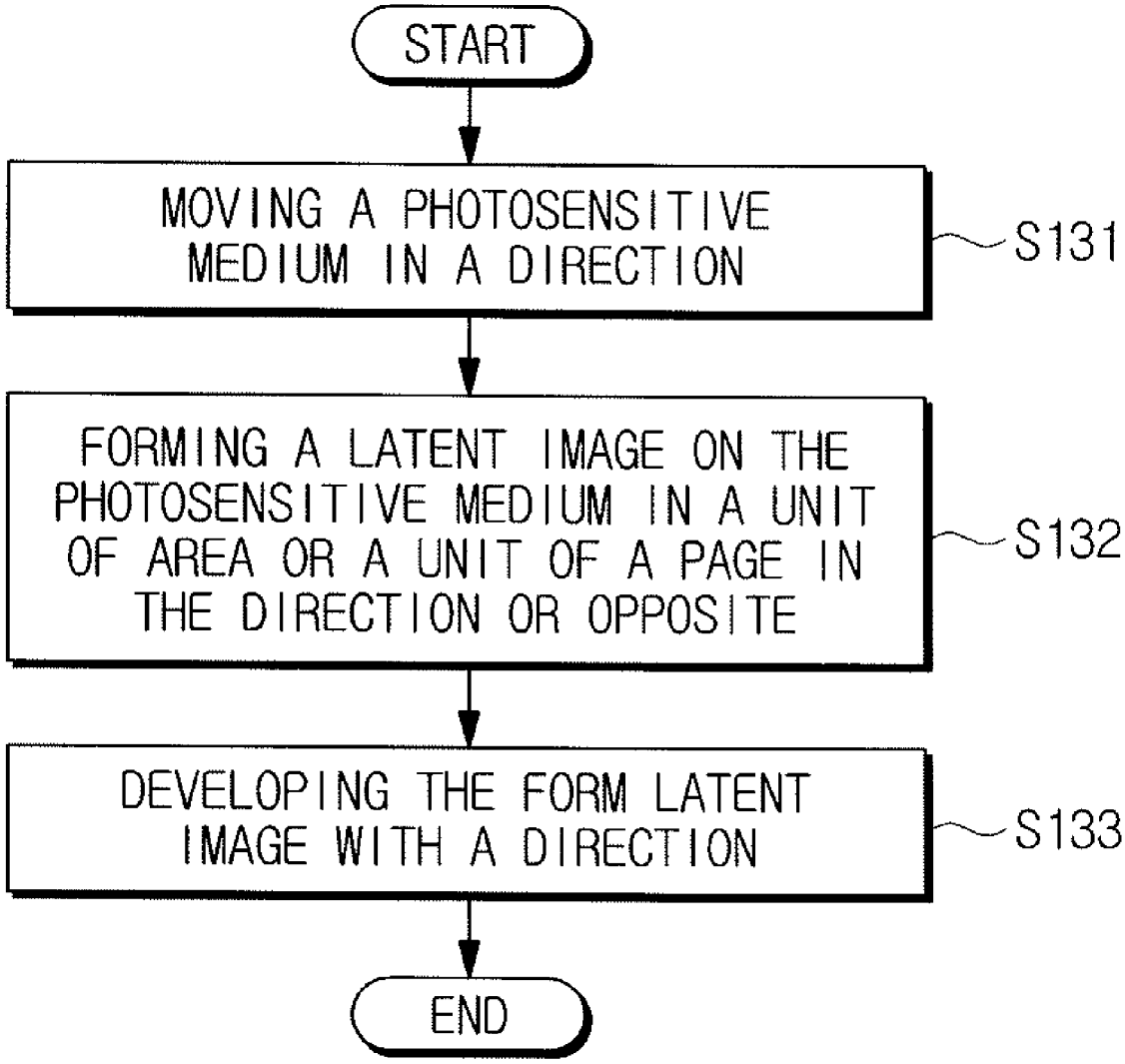
FIG. 13 is a view illustrating a method of an image forming apparatus according to an embodiment of the present general inventive concept.

FIG. 13 illustrates a method of an image forming apparatus according to an embodiment of the present general inventive concept. In operation 131, a photosensitive medium 120 is moved in a direction. In operation 132, an electrostatic latent image is formed on the photosensitive medium in a unit of area or a unit of a page in the direction, or a direction opposite to the direction. In operation 133, the formed electrostatic latent image with a direction is developed.

The present general inventive concept can also be embodied as computer-readable codes on a computer-readable recording medium. The computer-readable recording medium is any data storage device that can store data which can be thereafter read by a computer system. Examples of the computer-readable recording media include read-only memory (ROM), random-access memory (RAM), CD-ROMs, magnetic tapes, floppy disks, optical data storage devices, and carrier waves (such as data transmission through the Internet). The computer-readable recording medium can also be distributed over network-coupled computer systems so that the computer-readable code is stored and executed in a distributed fashion. Also, functional programs, codes, and code segments to accomplish the present general inventive concept can be easily construed by programmers skilled in the art to which the present general inventive concept pertains.

Figure 14:
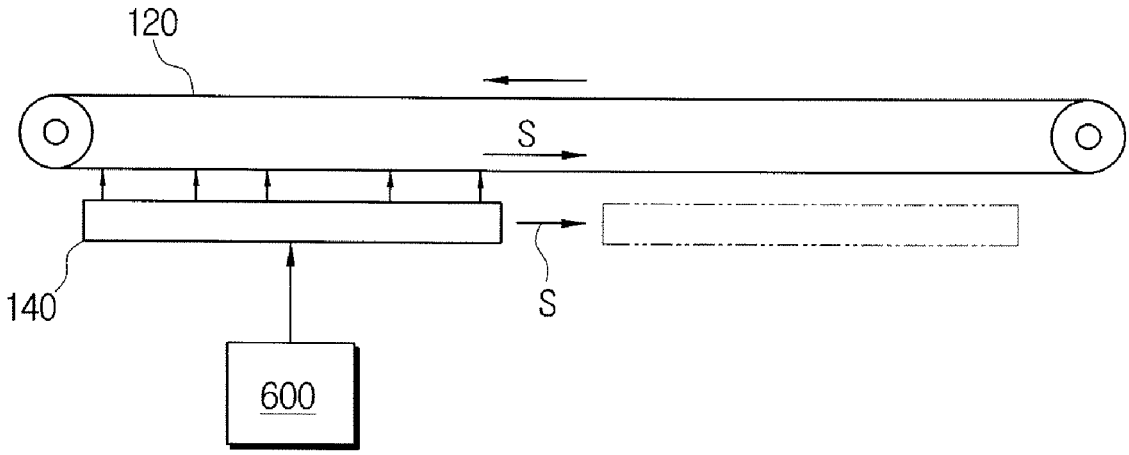
FIG. 14 is a view illustrating an image forming apparatus according to an exemplary embodiment of the present invention.

Referring to FIG. 14, an image forming apparatus according to a seventh exemplary embodiment of the present invention may have a photosensitive belt 120 as a photosensitive medium which runs in a direction with a predetermined speed (s). In this embodiment, a display unit 140 opposite to the photosensitive belt 120 is reciprocally movable in the running direction of the photosensitive belt 120 within a predetermined distance. The display unit 140 may be reciprocally moved by a reciprocating unit 600. The reciprocating unit 600 may be implemented in many different configurations, and should not be limited to a particular example. For example, the reciprocating unit 600 may be a linear motor, or a reciprocating structure using a cam.

According to the exemplary embodiment of FIG. 14, the display unit 140 is moved by the reciprocating unit 600 in the same direction and with the same speed as the photosensitive belt 120. While the display unit 140 is moved along with the photosensitive belt 120, the display unit 140 forms an electrostatic latent image on the opposite face of the photosensitive belt 120. Because the display unit 140 forms an electrostatic latent image onto the photosensitive belt 120 while moving together with the photosensitive belt 120, it is not necessary to stop the photosensitive belt 120 to form an electrostatic latent image, and as a result, printing time can be shortened.

As explained above, according to the present invention, the faster printing speed is provided, compared to an image forming apparatus using a conventional laser scanning unit (LSU).

Instead of using a conventional LSU, the display unit 540 is used, and therefore, the number of required parts is reduced, so that an image forming apparatus of simple structure can be provided.

Additionally, the image forming apparatus according to the present invention can basically prevent the problems inherent in the use of the conventional LSU, such as non-straight formation of images or a requirement of control techniques to prevent a non-straight image. As a result, a printed image of higher quality can be provided.

Additionally, by performing light exposure of a photosensitive medium within a short time by using the display unit, or more particularly, by exposing an entire page unit onto the photosensitive medium, irregular image densities due to mechanical errors of the photosensitive medium and the driving components can be prevented, and especially, irregular densities in the unit color images can be prevented.

Additionally, because the manner of exposing a photosensitive medium varies according to the photosensitiveness of the photosensitive medium and the output characteristics of the display unit, a variety of printing methods and embodiments suitable for the model types of the image forming apparatus, can be provided and therefore, efficient design is achieved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a display unit to output image data in the form of an image;

a photosensitive medium disposed along a direction to form an electrostatic latent image corresponding to the image outputted from the display unit;

a developing unit disposed adjacent to the display unit to develop the electrostatic latent image formed on the photosensitive medium along the direction;

a transfer unit to transfer the developed image of the photosensitive medium onto a printing medium; and a fixing unit to fix the transferred developed image in the printing medium.

2. The image forming apparatus of claim 1, further comprising a plurality of support rollers, wherein the photosensitive medium comprises a photosensitive belt to move in a direction, while being supported on the plurality of support rollers.

3. The image forming apparatus of claim 1, wherein the photosensitive medium comprises:

a photosensitive drum to rotate in a direction.

4. The image forming apparatus of claim 1, wherein the developing unit comprises:

a plurality of individually operating color developing units to develop the electrostatic latent image.

5. The image forming apparatus of claim 1, wherein the display unit is flexibly formed such that the display unit is deformable to a configuration of the photosensitive medium.

6. The image forming apparatus of claim 1, wherein the display unit comprises:

a movable unit to move the display unit close to or away from the photosensitive medium.

7. The image forming apparatus of claim 6, wherein the movable unit comprises:

a pressing member to press the display unit to move away from the photosensitive medium; and a driving unit to forcibly move the display unit close to the photosensitive medium against the force of the pressing member.

8. The image forming apparatus of claim 7, wherein the driving unit comprises:

a cam member.

9. The image forming apparatus of claim 7, wherein the driving unit comprises:

a solenoid.

10. The image forming apparatus of claim 1, further comprising:

a lens disposed between the display unit and the photosensitive medium to guide an image output from the display unit toward the photosensitive medium.

11. The image forming apparatus of claim 1, wherein the output image data is output in the form of an image including at least one of a red image, a green image and a blue image.

12. The image forming apparatus of claim 1, wherein the display unit comprises:

at least one of an LCD, a PDP, an LED and a CRT.

13. The image forming apparatus of claim 1, further comprising:

a reciprocating unit to reciprocate the display unit in the same direction as the photosensitive medium for a predetermined distance.

14. The image forming apparatus of claim 13, wherein the photosensitive medium comprises a photosensitive belt which runs in a direction with a predetermined speed, and the reciprocating unit drives the display unit in the same direction and with the same speed as the photosensitive belt.

15. A printing method, comprising:

forming an electrostatic latent image onto a photosensitive medium according to image data using an image output from a display unit, the forming of the electrostatic latent image comprising:

driving the photosensitive medium to move at a predetermined speed, forming a page unit of the electrostatic latent image onto the photosensitive medium by driving the display unit; and developing the electrostatic latent image on the photosensitive medium, wherein the forming of the page unit of electrostatic latent image, comprises:

increasing the driving velocity of the photosensitive medium until the electrostatic latent image area arrives at a developing zone.

16. A printing method, comprising:

forming an electrostatic latent image onto a photosensitive medium according to image data using an image output from a display unit, the forming of the electrostatic latent image comprising:

driving the photosensitive medium to move at a predetermined speed, forming a page unit of the electrostatic latent image onto the photosensitive medium by driving the display unit; and developing the electrostatic latent image on the photosensitive medium, wherein a relationship between a length (X) of the display unit and a length (s) of the image is expressed by a mathematical expression as follows:

$$X \geqq s.$$

17. A printing method, comprising:

forming an electrostatic latent image onto a photosensitive medium according to image data using an image output from a display unit, the forming of the electrostatic latent image comprising:

driving the photosensitive medium to move at a predetermined speed, forming a page unit of the electrostatic latent image onto the photosensitive medium by driving the display unit; and developing the electrostatic latent image on the photosensitive medium, wherein the forming of the page unit of the electrostatic latent image comprises:

forming the electrostatic latent image by driving image output pixels of the display unit by a plurality of stages and randomly.

18. A printing method, comprising:

forming an electrostatic latent image onto a photosensitive medium according to image data using an image output from a display unit, the forming of the electrostatic latent image comprising:

driving the photosensitive medium to move at a predetermined speed, forming a page unit of the electrostatic latent image onto the photosensitive medium by driving the display unit; and developing the electrostatic latent image on the photosensitive medium, wherein a relationship between a length (X) of the display unit and a length (s) of the image is expressed by a mathematical expression 2 as follows:

$$X \geqq [s + V_{B2} \times \Delta t \times (m-1)]$$

where $V_{B2}$ is a velocity of the photosensitive medium, $\Delta t$ is a delay time between random outputs, and m is a number of the random outputs.

19. A printing method, comprising:

forming an electrostatic latent image onto a photosensitive medium according to image data using an image output from a display unit, the forming of the electrostatic latent image comprising:

driving the photosensitive medium to move at a predetermined speed, forming a page unit of the electrostatic latent image onto the photosensitive medium by driving the display unit; and developing the electrostatic latent image on the photosensitive medium, wherein the forming of the page unit of the electrostatic latent image comprises:

forming the electrostatic latent image by driving image output pixels of the display unit in opposite direction to the driving direction of the photosensitive medium by a plurality of stages and randomly.

20. A printing method, comprising:

forming an electrostatic latent image onto a photosensitive medium according to image data using an image output from a display unit, the forming of the electrostatic latent image comprising:

driving the photosensitive medium to move at a predetermined speed, forming a page unit of the electrostatic latent image onto the photosensitive medium by driving the display unit; and developing the electrostatic latent image on the photosensitive medium, wherein a relationship between a length (X) of the display unit and a length (s) of the image is expressed by a mathematical expression 3 as follows:

$$X \geqq s \times V_{B3}/(V_{B3}+V_D)$$

where $V_{B3}$ is the velocity of the photosensitive medium, and $V_D$ is the velocity at which the display unit is driven in an opposite direction to the photosensitive medium by stages.

21. A printing method comprising:

forming an electrostatic latent image onto a photosensitive medium according to image data, using an image output from a display unit, the forming of an electrostatic latent image comprising:

stopping driving the photosensitive medium, driving the display unit and forming an electrostatic latent image on the photosensitive medium in a standstill position, and moving the photosensitive medium bearing the electrostatic latent image to a developing zone; and developing the electrostatic latent image on the photosensitive medium.

22. The printing method of claim 21, wherein the moving of the photosensitive medium bearing the electrostatic latent image comprises:

moving the photosensitive medium at maximum velocity.

23. The printing method of claim 21, wherein the driving of the display unit comprises:

simultaneously driving image output pixels of the display unit to form the electrostatic latent image at the same time.

24. The printing method of claim 21, wherein the driving of the display unit comprises:

forming the electrostatic latent image by driving image output pixels of the display unit by a plurality of stages and randomly.

25. The printing method of claim 21, wherein the driving of the display unit comprises:

forming the electrostatic latent image by driving image output pixels of the display unit in opposite direction to the driving direction of the photosensitive medium by a plurality of stages and randomly.

26. The printing method of claim 21, wherein:

the stopping of driving the photosensitive medium comprises moving the display unit close to the photosensitive medium; and the driving of the display unit comprises returning the display unit to an original position.

27. A printing method comprising:

forming an electrostatic latent image onto a photosensitive medium according to image data, using an image output from a display unit, the forming of an electrostatic latent image comprising:

driving the photosensitive medium with a predetermined speed, driving the display unit in the same direction as the photosensitive medium, and causing the display unit to form an electrostatic latent image while the display unit is driven; and developing the electrostatic latent image on the photosensitive medium.

28. The printing method of claim 27, wherein the driving the display unit comprises driving the display unit with the same speed as the photosensitive medium.

29. An image forming apparatus, comprising:

a photosensitive drum; and a display unit having a rounded surface to face a surface of the photosensitive drum to display image data to form an image.

* * * * *